US012415653B2

(12) United States Patent
Septien Rojas et al.

(10) Patent No.: US 12,415,653 B2
(45) Date of Patent: Sep. 16, 2025

(54) RECLOSABLE BAG HAVING A REPULPABLE ZIPPER

(71) Applicant: Illinois Tool Works Inc., Glenview, IL (US)

(72) Inventors: Jose Manuel Septien Rojas, Naperville, IL (US); Eric Plourde, Frankfort, IL (US); Kevin Olechowski, Bourbonnais, IL (US); Marion Johnson, Hoffman Estates, IL (US); Clifton Howell, Elburn, IL (US); Lars Wihlborg, Stratford, CT (US); David Galley, Manteno, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 279 days.

(21) Appl. No.: 17/965,581

(22) Filed: Oct. 13, 2022

(65) Prior Publication Data

US 2023/0128908 A1 Apr. 27, 2023

Related U.S. Application Data

(60) Provisional application No. 63/330,268, filed on Apr. 12, 2022, provisional application No. 63/271,928, filed on Oct. 26, 2021.

(51) Int. Cl.
*B65D 33/25* (2006.01)
*B65D 65/38* (2006.01)

(52) U.S. Cl.
CPC ..... *B65D 33/2541* (2013.01); *B65D 33/2589* (2020.05); *B65D 65/38* (2013.01); *B65D 2565/386* (2013.01)

(58) Field of Classification Search
CPC ..... B65D 33/25; B65D 33/2508; B65D 33/2516; B65D 33/2525; B65D 33/2533;
(Continued)

(56) References Cited

U.S. PATENT DOCUMENTS 5,121,997 A * 6/1992 La Pierre ..... B29C 48/155 383/203
5,200,035 A 4/1993 Bhat et al.
(Continued)

FOREIGN PATENT DOCUMENTS

WO 2013044933 A1 4/2013
WO 2015171034 A1 11/2015
WO 2021183629 A1 9/2021

OTHER PUBLICATIONS

"Voluntary Standard For Repulping and Recycling Corrugated Fiberboard Treated to Improve Its Performance in the Presence of Water and Water Vapor", Revised Aug. 16, 2013, 23 pages.
(Continued)

*Primary Examiner* — Nathan J Newhouse
*Assistant Examiner* — Nina K Attel
(74) *Attorney, Agent, or Firm* — The Small Patent Law Group LLC; Christopher R. Carroll

(57) ABSTRACT

A zipper for a reclosable bag includes a first interlocking element, and a second interlocking element. The first interlocking element and the second interlocking element are configured to cooperate to selectively open and close the zipper. One or both of the first interlocking element and the second interlocking element are formed of at least 85% repulpable material.

18 Claims, 5 Drawing Sheets

(58) Field of Classification Search
CPC ..... B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591
USPC ..... 383/61.1, 63, 64, 65
See application file for complete search history.

(56) References Cited

U.S. PATENT DOCUMENTS

| | | | | |
|---|---|---|---|---|
| 5,520,463 | A | 5/1996 | Tilman | |
| 6,063,224 | A * | 5/2000 | Tomic | B29C 48/21 24/DIG. 49 |
| 6,846,573 | B2 | 1/2005 | Seydel | |
| 7,067,581 | B2 | 6/2006 | Husemann et al. | |
| 7,244,509 | B1 | 7/2007 | Seydel | |
| 7,465,265 | B2 * | 12/2008 | Hinesley | B31B 50/8125 493/215 |
| 8,597,733 | B2 | 12/2013 | Vonfelden | |
| 9,637,866 | B2 | 5/2017 | Tilton | |
| 10,309,061 | B2 | 6/2019 | Chtourou et al. | |
| 11,214,427 | B2 | 1/2022 | Collison et al. | |
| 2004/0048061 | A1 | 3/2004 | Weissgerber et al. | |
| 2009/0123736 | A1 | 5/2009 | Green | |
| 2010/0008603 | A1 | 1/2010 | Smith et al. | |
| 2011/0138753 | A1 | 6/2011 | Justice et al. | |
| 2013/0174386 | A1 | 7/2013 | Koenigkramer | |
| 2020/0283959 | A1 | 9/2020 | Flynn et al. | |
| 2021/0284396 | A1 * | 9/2021 | Plourde | C08L 1/286 |

OTHER PUBLICATIONS

International Preliminary Report on Patentability mailed May 10, 2024 for corresponding International Application No. PCT/US2022/046665 (11 pages).

International Search Report and Written Opinion mailed Apr. 6, 2023 for corresponding International Application No. PCT/US2022/046665 (18 pages).

* cited by examiner

RECLOSABLE BAG HAVING A REPULPABLE ZIPPER

CROSS-REFERENCE TO RELATED APPLICATIONS

This application claims priority to U.S. Provisional Application No. 63/271,928 (filed 26 Oct. 2021) and U.S. Provisional Application No. 63/330,268 (filed 12 Apr. 2022), the entire contents of which are incorporated herein by reference.

BACKGROUND

Technical Field

The subject matter described herein relates to reclosable bags, and more particularly to zippers of reclosable bags.

Discussion of Art

It is well known that there is an increasing amount of plastic waste in the world. It is further well known that plastic waste in landfills or similar environments is very slow to biodegrade.

Plastic bags are used to contain various products, and typically include one or more films used to form an enclosure. While the film of a plastic bag has a thickness of only a few thousandths of an inch, the typical plastic polyethylene bag degrades very slowly, with essentially no degradation in thicker laminates.

Additionally, many known plastic bags include a zipper having flanges. However, the addition of a zipper with flanges poses additional problems in relation to degradation. For example, a zipper is typically much thicker than a film, and therefore degrades much slower than the film. Bioresins (that is, resins using biomass organic materials instead of traditional petroleum feedstock) can be used to facilitate degradation. However, further improvements in relation to degradation are sought, particularly such that maintain certain desired qualities.

BRIEF DESCRIPTION

A need exists for a reclosable bag having a zipper exhibiting increased repulpability, biodegradability, recyclability, and the like.

With that need in mind, certain embodiments of the present disclosure provide a zipper for a reclosable bag. The zipper includes a first interlocking element, and a second interlocking element. The first interlocking element and the second interlocking element are configured to cooperate to selectively open and close the zipper. One or both of the first interlocking element and the second interlocking element are formed of a material including air cavities.

In at least one embodiment, both the first interlocking element and the second interlocking element are formed of the material.

In at least one embodiment, the air cavities are formed through foaming.

In at least one embodiment, the material further includes filler. As an example, the filler includes cellulose.

In at least one embodiment, the zipper also includes a first flange extending from the first interlocking element, and a second flange extending from the second interlocking element. One or both of the first flange or the second flange can also be formed of the material. As a further example, the first flange and the second flange are both formed of the material.

As an example, a slider is operatively coupled to the zipper. The slider can also be formed of the material.

Certain embodiments of the present disclosure provide a method of forming a zipper for a reclosable bag. The method includes forming one or more air cavities within a material; and using the material to form one or both of a first interlocking element or a second interlocking element of the zipper, wherein the first interlocking element and the second interlocking element are configured to cooperate to selectively open and close the zipper.

In at least one embodiment, said forming includes foaming the air cavities within the material.

In at least one embodiment, said forming includes providing filler within the material.

In accordance with one example or aspect, a reclosable package is provided that includes a flexible sheet material having side walls. The side walls may be positioned to close an interior portion of the reclosable package. First and second mounting webs are coupled to upper areas of the side walls. A zipper assembly includes a first interlocking portion coupled to the first mounting web and a second interlocking portion coupled to the second mounting web. The first interlocking portion and the second interlocking portion mate with each other to close the zipper assembly and may separate from each other to open the zipper assembly. The first mounting web and the second mounting web are formed at least in part from a repulpable material.

In accordance with one example or aspect, a zipper assembly is provided that includes flanges having opposite interior and exterior surfaces. The exterior surfaces of the flanges are positioned to be coupled with one or more side walls of the enclosure. The flanges include interlocking members protruding from the flanges. The interlocking members are positioned to mate with each other and to close the enclosure and to separate from each other to open the enclosure. The flanges are formed at least in part from a repulpable material.

In accordance with one example or aspect, a method is provided that includes coupling a first mounting portion with one or more panels. The first mounting portion and the one or more panels are formed at least in part from a repulpable material. The method includes coupling a second mounting portion with one or more panels. The second mounting portion is formed at least in part of a repulpable material. A first interlocking portion of a zipper assembly is coupled to the first mounting portion. A second interlocking portion of the zipper assembly is coupled to the second mounting portion.

In accordance with one example or aspect, a method is provided that includes coupling a zipper assembly onto a mounting portion. The mounting portion is formed at least in part from a repulpable material. The zipper assembly and mounting portion are coupled to a panel of an enclosure. The zipper assembly is openable to open and close the enclosure.

BRIEF DESCRIPTION OF THE DRAWINGS

The inventive subject matter may be understood from reading the following description of non-limiting embodiments, with reference to the attached drawings, wherein below.

DETAILED DESCRIPTION

Certain embodiments of the present disclosure provide a zipper for a reclosable container, such as a bag. The zipper is formed of a dissolvable material. In at least one embodiment, the zipper is formed of a dissolvable material containing air cavities, which increase solubility. In at least one embodiment, the dissolvable material also contains a filler, such as wood fiber, to limit or otherwise control the formation of the air cavities. Filler, like air cavities, also reduces an amount of polymeric binder used to form the zipper and/or the container. As an example, the filler can be formed, at least in part, of cellulose.

Foaming can be used to form the air cavities. For example, foaming has been used in extruded polyethylene zippers, as disclosed in U.S. Pat. No. 5,520,463, entitled "Foamed Zipper" issued May 28, 1996, which is hereby incorporated by reference in its entirety. United States Patent Application Publication No. 2013/0174386, entitled "More Sustainable Biodegradable Foamed Zipper," published Jul. 11, 2013, which is hereby incorporated by reference in its entirety, also discloses forming a zipper through foaming. In at least one example, the air cavities can be formed using a foaming process, such as described in U.S. Pat. No. 5,520,463, or United States Patent Application Publication No. 2013/0174386.

It has been found that a zipper having air cavities formed through foaming, and also including a cellulose-based filler may aid in meeting standards and requirements as promulgated by the Flexible Box Associations.

If filler is used in the zipper, a ratio of air cavities and filler content can be adjusted, as desired, to affect certain mechanical properties of the zipper. For example, increased air cavities increases flexibility, while the filler can increase stiffness.

The zipper may or may not include flanges. The presence of air cavities and filler can be present in an entirety of the zipper, or in less than an entirety of the zipper. Further, a slider and/or a clip used in relation to the zipper can also be formed of the same material as the zipper.

Figure 1:
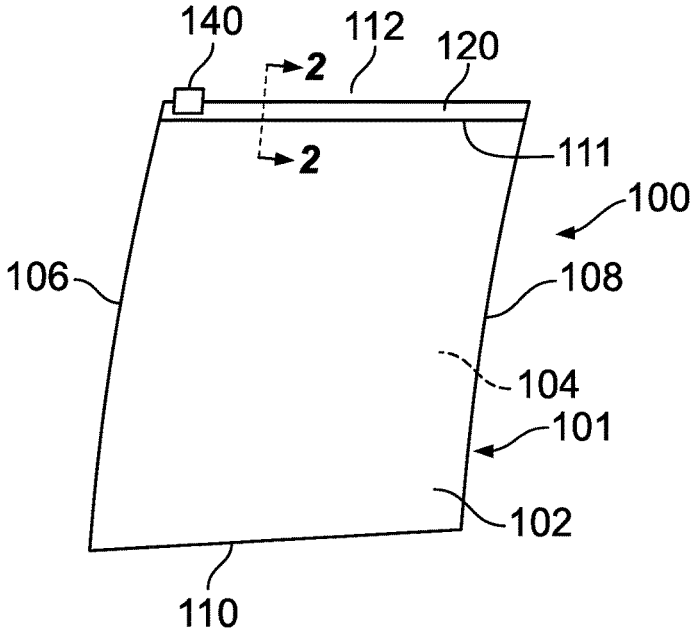
FIG. 1 illustrates a front view of reclosable bag, according to an embodiment of the present disclosure.

FIG. 1 illustrates a front view of reclosable bag 100, according to an embodiment of the present disclosure. The bag 100 includes a container 101 including a front wall 102 that is coextensive with a rear wall 104. The front wall 102 and the rear wall 104 can be joined to each other by side seals 106, 108, and a bottom seal 110 (or optionally a fold). Upper edges 111 define a mouth 112, which is reclosable by a zipper 120.

In at least one embodiment, the container 101 is formed of a biodegradable material. For example, the container 101 can be formed of paper, which may or may not be coated. Alternatively, the container 101 can be formed of a polymeric material.

Figure 2:
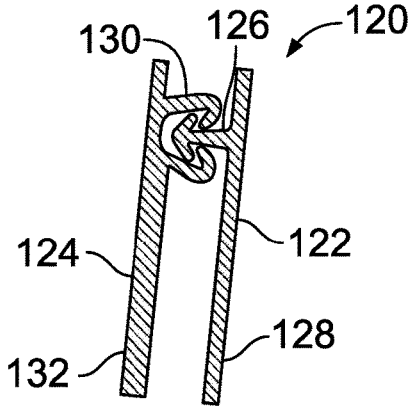
FIG. 2 illustrates a cross-sectional view of a zipper of the reclosable bag along line 2-2 of FIG. 1.

FIG. 2 illustrates a cross-sectional view of the zipper 120 of the reclosable bag 100 along line 2-2 of FIG. 1. The zipper 120 includes a first profile 122 and a second profile 124 opposite from the first profile 122. The first profile 122 and the second profile 124 including cooperating interlocking elements. In particular, the first profile 122 includes a first or male interlocking element 126 and a first flange 128 (such as extending from or otherwise coupled to the male interlocking element 126), and the second profile 124 includes a second or female interlocking element 130 and a second flange 132 (such as extending from or otherwise coupled to the female interlocking element 130). It is to be understood that the terms "first," "second," and the like are merely used to denote a number of items. For example, the female interlocking element 130 can be considered the first interlocking element, and the male interlocking element 126 can be considered the second interlocking element.

Referring to FIGS. 1 and 2, the first profile 122 is sealed to the front wall 102 while second profile 124 is sealed to the rear wall 104. In the closed or interlocked position, the male interlocking element 126 is received and engaged with the female interlocking element 130. In the open position, the male interlocking element 126 and the female interlocking elements 130 are free of engagement with each other.

In at least one embodiment, the slider 140 may also be used in relation to the zipper 120. That is, the slider 140 can be operatively coupled to the zipper 120. The slider 140 can be moved in an opening direction to separate the male interlocking element 126 from the female interlocking elements 130. Conversely, the slider can be moved in a closing direction to interlock the male interlocking element 126 and the female interlocking element 130. Optionally, the bag 100 may not include the slider 140.

Figure 3:
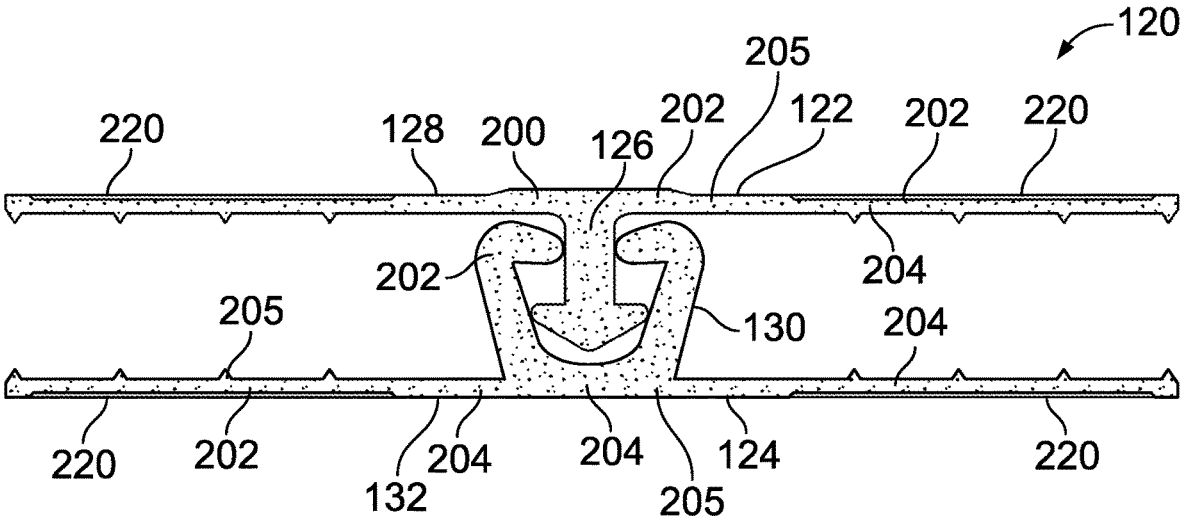
FIG. 3 illustrates a cross-sectional view of a zipper according to an embodiment of the present disclosure.

FIG. 3 illustrates a cross-sectional view of the zipper 120 according to an embodiment of the present disclosure. At least a portion of the zipper 120 is formed of a material 200 having a plurality of air cavities 202. The material 200 can also include filler 204 dispersed therethrough. A remainder or substrate 205 of the material 200 (other than the air cavities 202 and the filler 204) can be formed of a plastic, for example.

An entirety of the zipper 120 can be formed of the material 200. For example, the male interlocking element 126, the female interlocking element 130, the first flange 128, and the second flange 132 can all be formed of the material 200. In at least one embodiment, the zipper 120 does not include one or both of the first flange 128 or the second flange 132.

As another example, less than an entirety of the zipper 120 can be formed of the material 200. For example, only the male interlocking element 126 and/or the female interlocking element 130 can be formed of the material 200, while the remaining portions (such as the first flange 128 and the second flange 132) may be formed of a different material (for example, a plastic that does not include the air cavities 202 and/or the filler 204). Forming less than entirety of the zipper 120 from the material 200 may be desired, such as if certain standards allow for a certain amount of the zipper (such as 15%) to not exceed biodegradability and/or repulpability requirements.

Referring to FIGS. 1 and 3, the slider 140 can also be formed of the material 200. Optionally, the slider 140 may not be formed of the material 200. As noted, the bag 100 may or may not include the slider 140.

As shown, one or more sealing areas 220 can be coupled to outer surfaces of the first flange 128 and/or the second flange 132. Referring to FIGS. 1 and 3, the sealing areas 220 sealingly engage interior surfaces of the container 101 proximate to the mouth 112. The seals 220 may or may not be formed, at least in part, of the material 200. In at least one example, instead of being formed of the material 200, the sealing areas 220 can be formed of a sealant and/or adhesive.

The material 200 is dissolvable. The air cavities 202 increase the solubility of the material 200. In at least one example, the air cavities 202 are formed through foaming. For example, foaming agents form the air cavities 202. The air cavities 202 reduce the overall amount and weight of the zipper 120, while increasing surface area. The increased surface area provides increased area for compostability, for example, thereby reducing the time for such process.

In at least one embodiment, the filler 204 is a cellulose-based material. For example, the filler 204 is formed, at least in part, of cellulose. As an example, the filler 204 can be wood fiber. The filler 204 limits or otherwise controls the formation of the air cavities 202. The filler 204, like the air cavities 202, also reduces an amount of polymeric binder used to form the zipper 120 and/or the container 101.

The ratio of the air cavities 202 to the filler 204 within the material 200 can be 1:1. Optionally, the ratio of the air cavities 202 to the filler 204 can be 2:1, 3:1, or the like. Notably, increasing the percentage of the air cavities 202 within the material 200 increases the flexibility of the zipper 120. Conversely, the ratio of the air cavities 202 to the filler 204 can be 1:2, 1:3, or the like. Increasing the percentage of the filler 204 within the material 200 increases the stiffness and rigidity of the zipper 120. As such, the amount of the air cavities 202 and the filler 204 can be adjusted depending on a desired amount of flexibility and stiffness. Alternatively, the material 200 may not include the filler 204.

It has been found that the zipper 120 having the air cavities 202 formed through foaming, and also including the filler 204, which can be cellulose-based, may aid in meeting standards and requirements as promulgated by the Flexible Box Associations.

By forming at least a portion of the zipper 120 from the material 200, the zipper 120 is more biodegradable, repulpable, recyclable, and compostable in comparison to known zippers. The material 200 can be dissolvable.

As described herein, the zipper 120 for a reclosable bag 100 includes a first interlocking element 126 or 130, and a second interlocking element (the other of 126 or 130). The first interlocking element and the second interlocking element are configured to cooperate to selectively open and close the zipper 120. One or both of the first interlocking element and the second interlocking element are formed of the material 200 including air cavities 202. The air cavities 202 can be formed through foaming. In at least one example, both the first interlocking element and the second interlocking element are formed of the material 200. In at least one example, the material 200 also includes the filler 204. As an example, the filler 204 includes cellulose.

Figure 4:
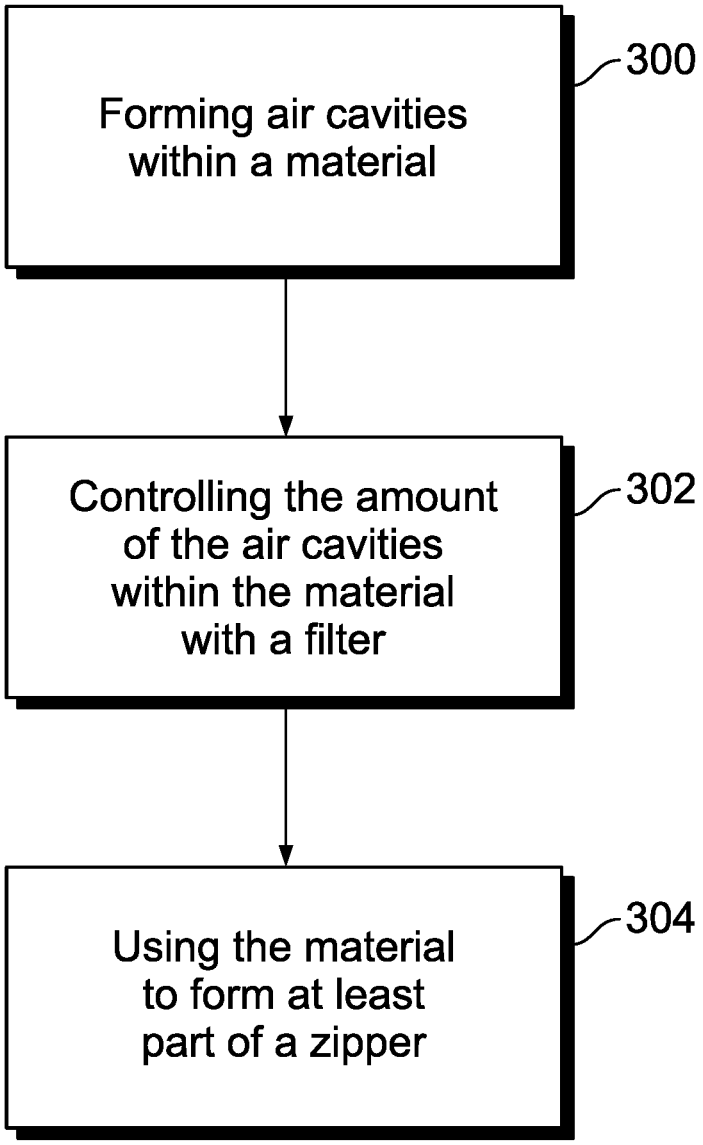
FIG. 4 illustrates a flow chart of a method of forming a zipper, according to an embodiment of the present disclosure.

FIG. 4 illustrates a flow chart of a method of forming a zipper, according to an embodiment of the present disclosure. Referring to FIGS. 3 and 4, at 300, air cavities 202 are formed within the material 200. At 302, the amount of air cavities 202 within the material 200 are controlled by a filler 204 (that is, the addition of the filler 204 into the material 200). Optionally, the amount of air cavities 202 can be independent of the filler 204. At 304, the material 200 is then used to form at least part of the zipper 120.

In one example, a zipper for a reclosable bag is provided. The zipper may include a first interlocking element and a second interlocking element. The first interlocking element and the second interlocking element are configured to cooperate to selectively open and close the zipper. One or both of the first interlocking element and the second interlocking element may be formed of a material including air cavities.

Optionally, both the first interlocking element and the second interlocking element may be formed of the material that includes the air cavities. The air cavities may be formed through foaming. The material may also include filler, such as cellulose. The zipper also may include a first flange extending from the first interlocking element, and a second flange extending from the second interlocking element. One or both of the first flange or the second flange also may be formed of the material. A slider may be operatively coupled to the zipper. The slider also may be formed of the material.

In another example, a method of forming a zipper for a reclosable bag is provided. The method may include forming one or more air cavities within a material, and using the material to form one or both of a first interlocking element or a second interlocking element of the zipper. The first interlocking element and the second interlocking element may cooperate to selectively open and close the zipper.

The material may be used to form both the first interlocking element and the second interlocking element. Air cavities may be formed within the material. The forming operation may include providing filler within the material, such as cellulose.

The material may be used to form one or both of the first flange or a second flange of the zipper. The material also may be used to form a slider configured to operatively couple to the zipper.

In another example, a zipper for a reclosable bag is provided. The zipper may include a first interlocking element and a second interlocking element. The first interlocking element and the second interlocking element may cooperate to selectively open and close the zipper. The first interlocking element and the second interlocking element may be formed of a material including air cavities and filler, where the air cavities are formed through foaming.

The filler may include cellulose. The zipper also may include a first flange extending from the first interlocking element, and a second flange extending from the second interlocking element. The first flange and the second flange also may be formed of the material.

As described herein, embodiments of the present disclosure provide a zipper for a reclosable bag exhibiting increased repulpability, biodegradability, recyclability, and the like.

Certain embodiments of the present disclosure provide a reclosable enclosure having a zipper assembly, such as a bag. The zipper assembly may be formed at least in part of a repulpable material. The zipper assembly may be coupled to the reclosable container using a mounting web that is formed at least in part of a repulpable material.

Figure 5:
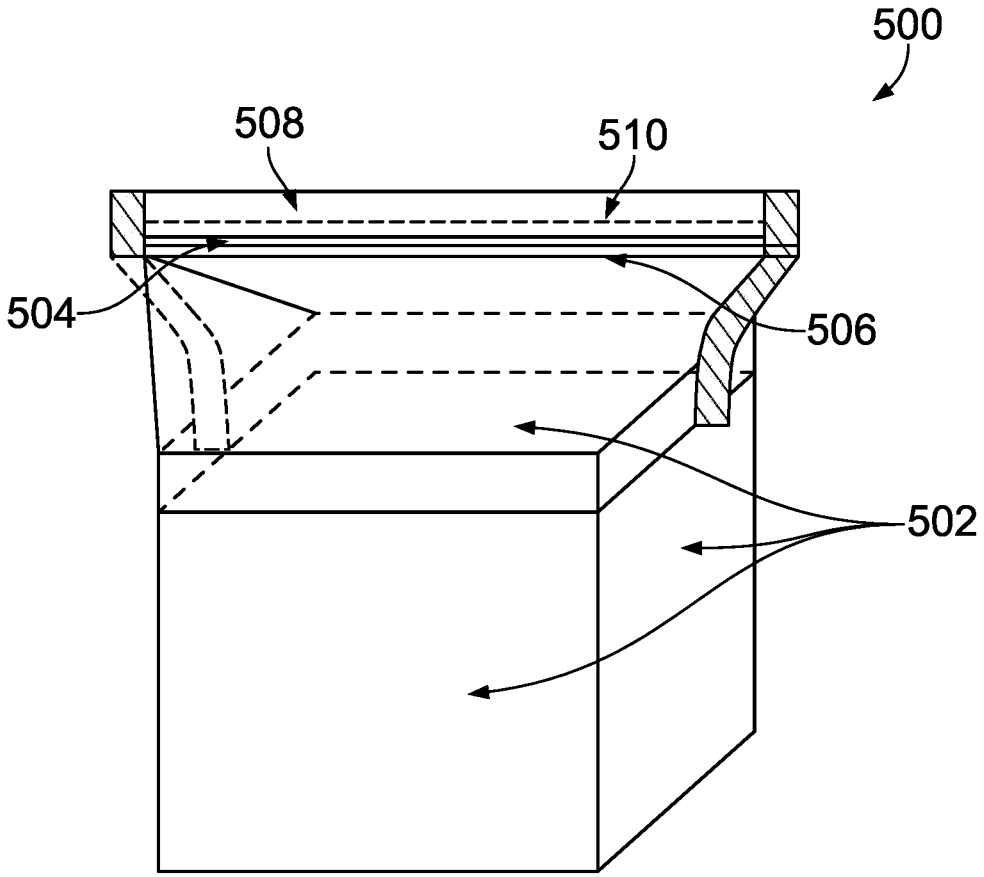
FIG. 5 illustrates a front view of a reclosable enclosure, according to an embodiment.

FIG. 5 illustrates a front view of one example of a reclosable enclosure 500. The enclosure may include a flexible sheet material with one or more side walls 502. The one or more side walls 502 may be arranged to close an interior portion of the enclosure 500. A zipper assembly 504 may be coupled to the side walls 502 at or near an opening area 506 of the enclosure 500. A first mounting web may be coupled to a first side wall and a second mounting web may be coupled to a second side wall, opposite the first side wall. The zipper assembly 504 may be coupled to the first mounting wall and the second mounting wall, allowing the zipper assembly 504 to open and close the enclosure 500. In the embodiment illustrated in FIG. 5, the opening area 506 may be covered by a removable portion 508. The removable portion 508 may include perforations 510 and a tear bead area that may assist a user in removing the removable portion 508. The zipper assembly 504 may attach to itself to allow the user to repeatedly open and close the enclosure 500. In one embodiment, the zipper assembly 504 is heat sealed directly to the side walls 502.

In at least one embodiment, the reclosable enclosure 500 is formed of a repulpable material. For example, the reclosable enclosure 500 can be formed of paper, which may or may not be coated. The repulpable material may be cellulose-based material, wood fiber, or the like.

Figure 6:
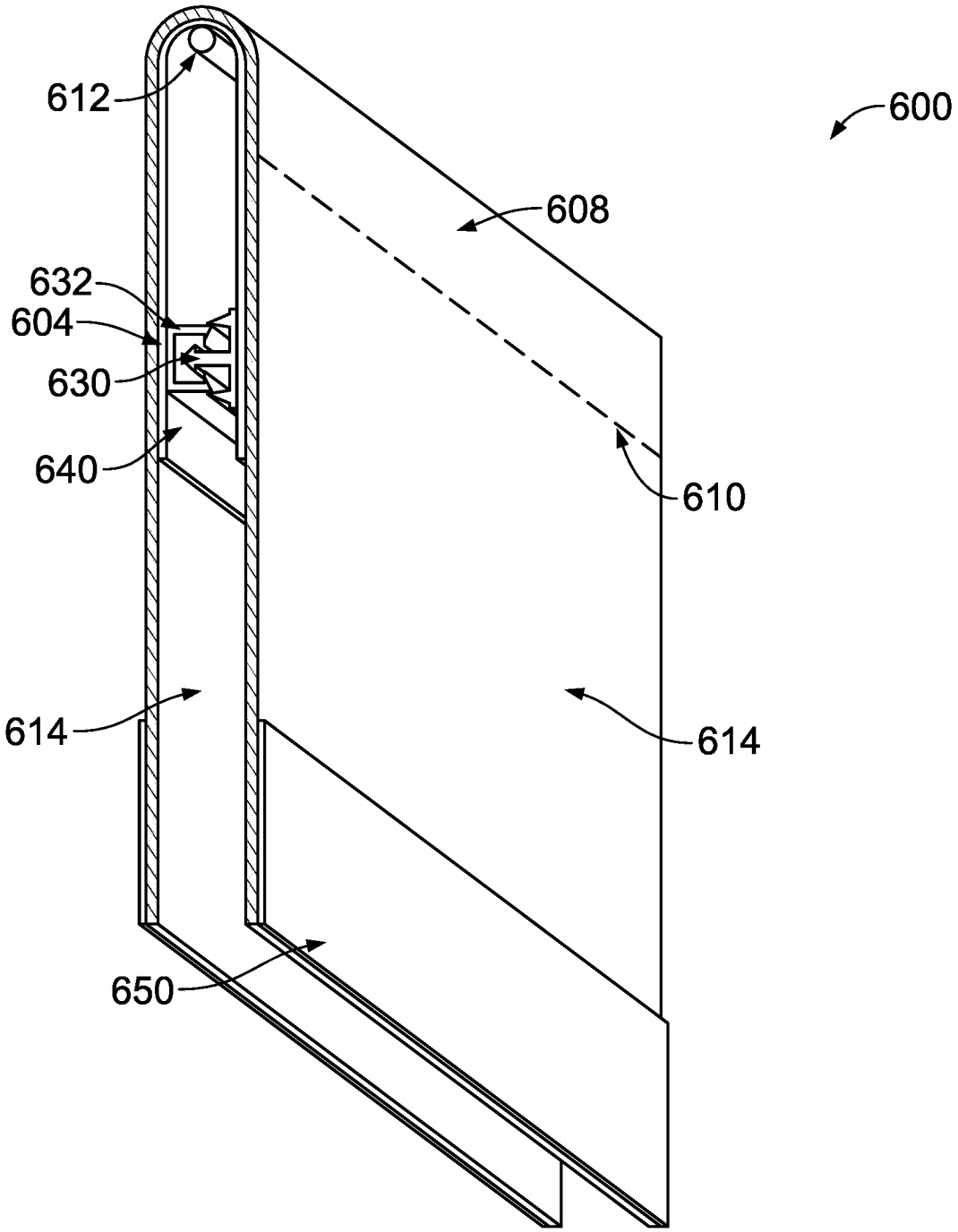
FIG. 6 disclosure illustrates a cross-sectional view of one example of a reclosable assembly.

FIG. 6 illustrates a cross-sectional view of one example of a reclosable assembly 600. The reclosable assembly 600 includes a zipper assembly 604 and a mounting web portion 614. The zipper assembly 604 is coupled to the mounting web portion 614. In the illustrated embodiment, the zipper assembly 604 is coupled to the mounting web portion 614 by a base portion 640. The base portion 640 may be extrusion coated or may be an uncoated material. The zipper assembly 604 may include a first interlocking portion 630 and a second interlocking portion 632 that are positioned to cooperate to selectively open and close the zipper assembly 604. In one embodiment, the first interlocking portion 630 is coupled to a first side wall and the second interlocking portion 632 is coupled to an opposite second side wall. The first mounting web and the second mounting web may be formed at least in part from a repulpable material. In the embodiment illustrated in FIG. 6, the reclosable assembly 600 may be covered by a removable portion 608. The removable portion 608 may include perforations 610 and a tear bead area 612 that may assist a user in removing the removable portion 608. The reclosable assembly 600 may be coupled to a reclosable enclosure, such as one or more of the enclosures described and/or shown herein. In the illustrated embodiment, the reclosable assembly 600 includes a strip 650 that is positioned to be coupled with the reclosable enclosure. The strip 650 may be polyethlene, an adhesive, or the like. Coupling the reclosable assembly 600 to the enclosure 500 may allow the zipper assembly 604 to attach to itself to allow the user to repeatedly open and close the enclosure 500.

In at least one embodiment, the mounting web portion 614 is formed of a repulpable material. For example, the mounting web portion 614 can be formed of paper, which may or may not be coated. The repulpable material may be cellulose-based material, wood fiber, or the like.

Figure 7:
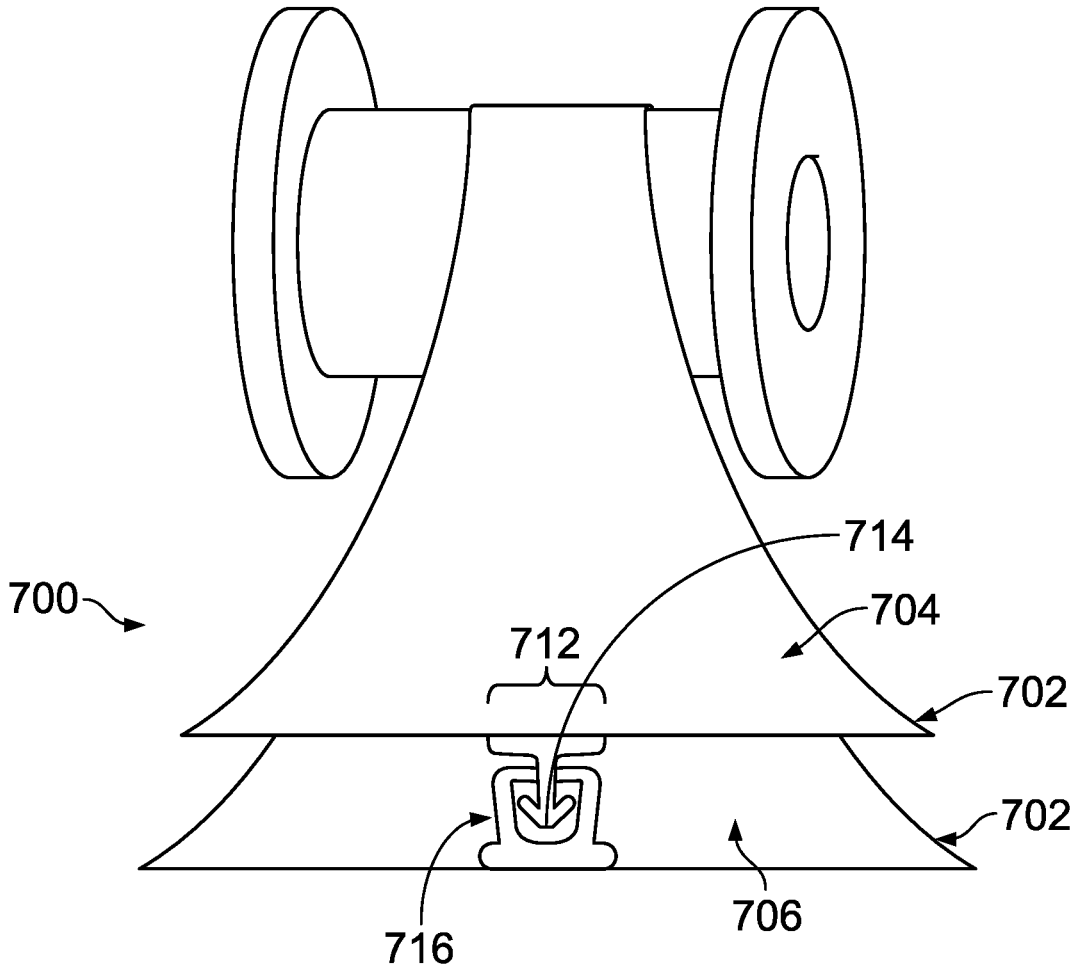
FIG. 7 illustrates a cross-sectional view of a zipper assembly of the reclosable enclosure of FIG. 1 or FIG. 5.

FIG. 7 illustrates one example of a zipper assembly 700. The zipper assembly 700 can be incorporated into the enclosures shown in FIG. 1 and/or FIG. 5. The zipper assembly 700 may include opposing flanges 702 having outer surfaces 704 that face away from each other. These outer surfaces 704 may be coupled (e.g., via heat sealing, an adhesive, or the like) to the mounting webs (shown in FIG. 5) of the enclosure (also shown in FIG. 5). Opposite inner surfaces 706 of the flanges 702 can face each other. The inner surfaces 706 of the flanges 702 include interlocking or locking elements 712 that protrude from the inner surfaces 706 toward the other flange 702. These locking elements 712 may mate with each other to close the zipper assembly 700 (and enclosure). The interlocking elements 712 may be pulled apart (e.g., by a consumer pulling on opposite sides of the side walls and/or the flanges 702) to open the enclosure 500. In the illustrated example, one flange 702 includes male interlocking elements 714 and the other flange 702 includes female interlocking elements 716. As shown, the female interlocking elements 716 may be receptacles shaped to receive and secure outer ends of the male interlocking elements 714 (to keep the enclosure 500 closed). Pulling the flanges 702 and/or side walls apart may remove the male interlocking elements 714 from the female interlocking elements 716 to open the enclosure 500. In one example, a slider may be used that moves along the length of the zipper assembly 700 (e.g., into and out of the plane of FIG. 7) to open or close the zipper assembly 700 and enclosure 500. Alternatively, the zipper assembly 700 may be opened or closed without the slider.

The body of the zipper assembly 700 may incorporate repulpable material. For example, the entirety of the flanges 702 may be formed from repulpable material or a combination of repulpable material and another material, such as a polymer. In one embodiment, the zipper assembly 700 may be formed at least in part from a water-soluble polymer material. In one embodiment, the zipper assembly 700 may be formed at least in part from a polyethylene material, polyvinyl alcohol (PVOH), or the like.

In the closed or interlocked position, the male interlocking element 714 is received and engaged with the female interlocking element 716. In the open position, the male interlocking element 714 and the female interlocking elements 716 are free of engagement with each other.

In at least one embodiment, a slider may also be used in relation to the zipper assembly. That is, the slider can be operatively coupled to the zipper assembly. The slider can be moved in an opening direction to separate the male interlocking element from the female interlocking element. Conversely, the slider can be moved in a closing direction to interlock the male locking element and the female interlocking element. Optionally, the reclosable enclosure may not include the slider.

As described herein, embodiments of the present disclosure provide a zipper assembly for a reclosable enclosure exhibiting increased repulpability, biodegradability, recyclability, and the like.

In one embodiment, a method is described for manufacturing reclosable enclosures and zipper assemblies of reclosable enclosures. The method may be used in the manufacturing of the reclosable enclosure 100 shown in FIG. 1. It should be noted that the particular arrangement of components (e.g., the number, types, placement, or the like) described may be modified in various alternate embodiments. The method includes coupling a first mounting portion and a second mounting portion with one or more panels forming a reclosable enclosure. The first and second mounting portions and the panels may be formed at least in part from a repulpable material. The mounting portions may include a sealant layer. A first interlocking portion and a second interlocking portion of a zipper assembly are then coupled to the first and second mounting portions, respectively. In one embodiment, the interlocking portions are extruded directly onto the mounting portions. In one embodiment, the zipper assembly may be heat sealed to the mounting portion.

In another embodiment, a method is described for manufacturing reclosable enclosures and zipper assemblies of reclosable enclosures that includes coupling a zipper assembly onto a mounting portion. The mounting portion may be formed at least in part from a repulpable material. The zipper assembly and mounting portion may be coupled to a panel of an enclosure. The zipper assembly is arranged to open and close an interior of the enclosure.

The amount of repulpable material that is incorporated into one or more components of the enclosures described herein may be at least a threshold amount. For example, there may be at least 85% (but less than 100%) of repulpable material in the panels, zipper assemblies, flanges, interlocking elements, flanges, tear bands, mounting webs, sheets, etc. by weight and/or by volume (with the remainder being material that is not repulpable). Alternatively, there may be at least 80%, at least 70%, or the like (but less than 100%) of repulpable material in the panels, zipper assemblies, flanges, interlocking elements, flanges, tear bands, mounting webs, sheets, etc. by weight and/or by volume (with the remainder being material that is not repulpable). The amount of repulpable material may be expressed or measured as a fiber yield on weight per the Fibre Box Association repulpability test dated 16 Aug. 2013, the contents of which are incorporated herein by reference without limiting the scope of any embodiment described herein (unless currently or subsequently expressly limited by the applicant).

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A reclosable bag comprising:

walls forming an enclosure;

a mounting web coupled with the walls, the mounting web formed from a first material;

a base portion coupled with the mounting web, the base portion formed from a second material; and interlocking elements coupled with the base portion, the interlocking elements configured to engage each other to hold the enclosure closed and release from each other to open the enclosure, the interlocking elements formed from a third material, wherein at least one of the first material, the second material, and the third material is formed from at least 85% of a repulpable material, and wherein two of the first material, the second material, and the third material are different materials.

2. The reclosable bag of claim 1, wherein the third material that forms the interlocking elements includes the at least 85% of the repulpable material and includes air cavities.

3. The reclosable bag of claim 2, wherein the third material that forms the interlocking elements also includes cellulose filler.

4. The reclosable bag of claim 1, further comprising:

a slider formed from cellulose filler and air cavities.

5. The reclosable bag of claim 1, wherein the mounting web includes a sealant layer that adheres the mounting web to the walls.

6. The reclosable bag of claim 1, wherein the interlocking elements are heat sealed to the base portion.

7. The reclosable bag of claim 1, wherein the interlocking elements are extruded directly onto the base portion before the mounting web is coupled to an upper area of the walls.

8. The reclosable bag of claim 1, further comprising:

polyethylene or adhesive strips coupling the mounting web to the walls.

9. A method comprising:

obtaining walls configured to form an enclosure;

coupling a mounting web formed from a first material to the walls;

coupling a base portion with the mounting web, the base portion formed from a second material; and coupling interlocking elements with the base portion, the interlocking elements engaging each other to hold the enclosure closed and releasing from each other to open the enclosure, the interlocking elements formed from a third material, wherein at least one of the first material, the second material, and the third material is formed from at least 85% of a repulpable material, and wherein two of the first material, the second material, and the third material are different materials.

10. The method of claim 9, wherein the third material that forms the interlocking elements includes the at least 85% of the repulpable material and includes air cavities.

11. The method of claim 10, wherein the third material that forms the interlocking elements also includes cellulose filler.

12. The method of claim 9, further comprising:

forming a slider from cellulose filler and air cavities, the slider configured to slide along the interlocking elements to engage the interlocking elements with each other and to release the interlocking elements from each other.

13. The method of claim 9, further comprising applying a sealant layer between the mounting web and the walls.

14. The method of claim 9, further comprising heat sealing the interlocking elements to the base portion.

15. The method of claim 9, wherein the interlocking elements are formed by directly extruding the interlocking elements onto the base portion before the mounting web is coupled to an upper area of the walls.

16. The method of claim 9, wherein coupling the mounting web to the walls includes coupling the mounting web to the walls with polyethylene or adhesive strips.

17. A reclosable bag comprising:

walls forming an enclosure;

a mounting web at least partially formed from a repulpable material and coupled with the walls;

a base portion coupled with the mounting web, the base portion formed from a material other than the repulpable material; and interlocking elements coupled with the base portion, the interlocking elements configured to engage each other to hold the enclosure closed and to release from each other to open the enclosure, wherein the interlocking elements are formed from at least 85% of the repulpable material.

18. The reclosable bag of claim 17, further comprising:

polyethylene or adhesive strips coupling the mounting web to the walls.

* * * * *